US011703214B1

(12) United States Patent
Wang et al.

(10) Patent No.: US 11,703,214 B1
(45) Date of Patent: Jul. 18, 2023

(54) LAMP HAVING A HIDDEN SWITCH

(71) Applicants: Wenhao Wang, Guangdong (CN); Xiaoqin Liu, Guangdong (CN); Qinghui Wang, Guangdong (CN)

(72) Inventors: Wenhao Wang, Guangdong (CN); Xiaoqin Liu, Guangdong (CN); Qinghui Wang, Guangdong (CN)

(73) Assignee: Shenzhen Jingrong Photoelectronic Technology Co., Limited, Shenzhen (CN)

( * ) Notice: Subject to any disclaimer, the term of this patent is extended or adjusted under 35 U.S.C. 154(b) by 0 days.

(21) Appl. No.: 17/938,663

(22) Filed: Oct. 6, 2022

(51) Int. Cl.
*F21V 23/04* (2006.01)
*F21S 6/00* (2006.01)
*F21Y 115/10* (2016.01)

(52) U.S. Cl.
CPC ..... *F21V 23/0421* (2013.01); *F21S 6/001* (2013.01); *F21Y 2115/10* (2016.08)

(58) Field of Classification Search
CPC ..... F21V 23/0421; F21S 6/001
See application file for complete search history.

(56) References Cited

U.S. PATENT DOCUMENTS 5,816,695 A * 10/1998 Lin ..... F21S 9/02 362/205
2004/0233681 A1* 11/2004 Yao ..... F21S 9/02 362/565
2005/0237738 A1* 10/2005 Shiau ..... F21L 4/005 362/202
2005/0254239 A1* 11/2005 Lin ..... F21S 6/001 362/227
2013/0223050 A1* 8/2013 Liu ..... F21V 33/0076 362/205
2015/0043211 A1* 2/2015 Liu ..... F21V 23/009 362/294

* cited by examiner

*Primary Examiner* — Christopher E Dunay

(57) ABSTRACT

A lamp includes a lamp body; and an illumination assembly including a lamp shade assembly including a shade and a seat; and a lamp board. The seat is threadedly secured to the lamp body. The lamp board is secured to a lower end of the seat and laterally extends out of the seat. The lamp board serves as a bottom of the seat. The lamp board includes two first electrodes fastened on a bottom and a plurality of second electrodes adjacent to an edge. The first and second electrodes are electrically connected to positive and negative terminals of a control circuit of the lamp board respectively. The first and second electrodes are positive and negative terminals of a light source respectively. A clockwise rotation of the illumination assembly threadedly secures to the lamp body and turns on the light source.

1 Claim, 4 Drawing Sheets

LAMP HAVING A HIDDEN SWITCH

FIELD OF THE INVENTION

The invention relates to lamps and more particularly to a lamp having a hidden switch and method of controlling on and off of the switch.

BACKGROUND OF THE INVENTION

A conventional lamp such as candle shaped light-emitting diode (LED) lamp can be controlled by a remote control or is provided with an on/off switch on its lamp body. Regarding the control using the remote control, it is easy to turn on or off all LED lamps at a time. Regarding the lamp body provided with the on/off switch, an individual may manually move the on/off switch to turn on or off the LED lamp incorporating the on/off switch. Typically, the on/off switch is provided on a base or an outer surface of the lamp body. However, it is difficult of placing the LED lamp on a flat surface if the projecting on/off switch is provided on the base of the lamp body. One solution is to form a cavity on the base with the on/off switch provided therein and the tip of the on/off switch is flush with the base. However, it is difficult of manually moving the on/off switch because it is provided in the cavity. Regarding the on/off switch provided on the outer surface of the lamp body, it is not visually aesthetic. Further, as long as the location of the on/off switch being on the base or the outer surface of the lamp body, a resilient piece based switch in the lamp body is required. However, the resilient piece based switch is limited in its useful life.

Thus, the need for improvement still exists.

SUMMARY OF THE INVENTION

The invention has been made in an effort to solve the problems of the conventional art by providing a lamp having a hidden switch having novel and nonobvious characteristics.

To achieve above and other objects of the invention, the invention provides a lamp comprising a lamp comprising a lamp body; and an illumination assembly comprising a lamp shade assembly including a shade and a seat; and a lamp board; wherein the seat is threadedly secured to the lamp body; the lamp board is secured to a lower end of the seat and laterally extends out of the seat; the lamp board is configured as a bottom of the seat; the lamp board includes two first electrodes fastened on a bottom and a plurality of second electrodes adjacent to an edge; the first electrodes and the second electrodes are electrically connected to a positive terminal and a negative terminal of a control circuit of the lamp board respectively; the first electrodes and the second electrodes are positive and negative terminals of a light source respectively; an electrical connection of the first electrodes and the second electrodes activates the control circuit of the lamp board and turns on the light source; and an electrical disconnection of the first electrodes from the second electrodes deactivates the control circuit of the lamp board and turns off the light source.

Preferably, there are further comprised of a plurality of screw threads above the seat, and a threaded section on an inner surface of the lamp body, the threaded section being secured to the screw threads.

Preferably, there are further comprised of a limit protuberance provided on the seat and a cavity provided on the inner surface of the lamp body for complementarily receiving the protuberance, wherein the cavity is adjacent to an end of the threaded section.

Preferably, there are further comprised of a plurality of pairs of second projections on the screw threads.

Preferably, there are further comprised of a plurality of first projections on the inner surface of the lamp body above the threaded section, the first projections being configured as threads.

Preferably, the lamp body is a hollow cylinder and has an opening on a top, further comprising a battery in the lamp body and a resilient electrode in the lamp body, the resilient electrode having a first end on a bottom of the lamp body and engaged with an inner surface of the lamp body, and a second end on an end of the battery, the second end being in contact with the second electrode.

Preferably, there is further comprised of an O-ring disposed under the shade and above the screw threads.

Preferably, the light source is an LED capable of emitting color light.

The invention has the following advantages and benefits in comparison with the conventional art: a clockwise rotation turns on the lamp and a counterclockwise rotation turns off the lamp. It is simple and reliable and the hand feeling of the rotation is so right. The switch has a prolonged useful life.

The above and other objects, features and advantages of the invention will become apparent from the following detailed description taken with the accompanying drawings

DETAILED DESCRIPTION OF THE INVENTION

Figure 1:
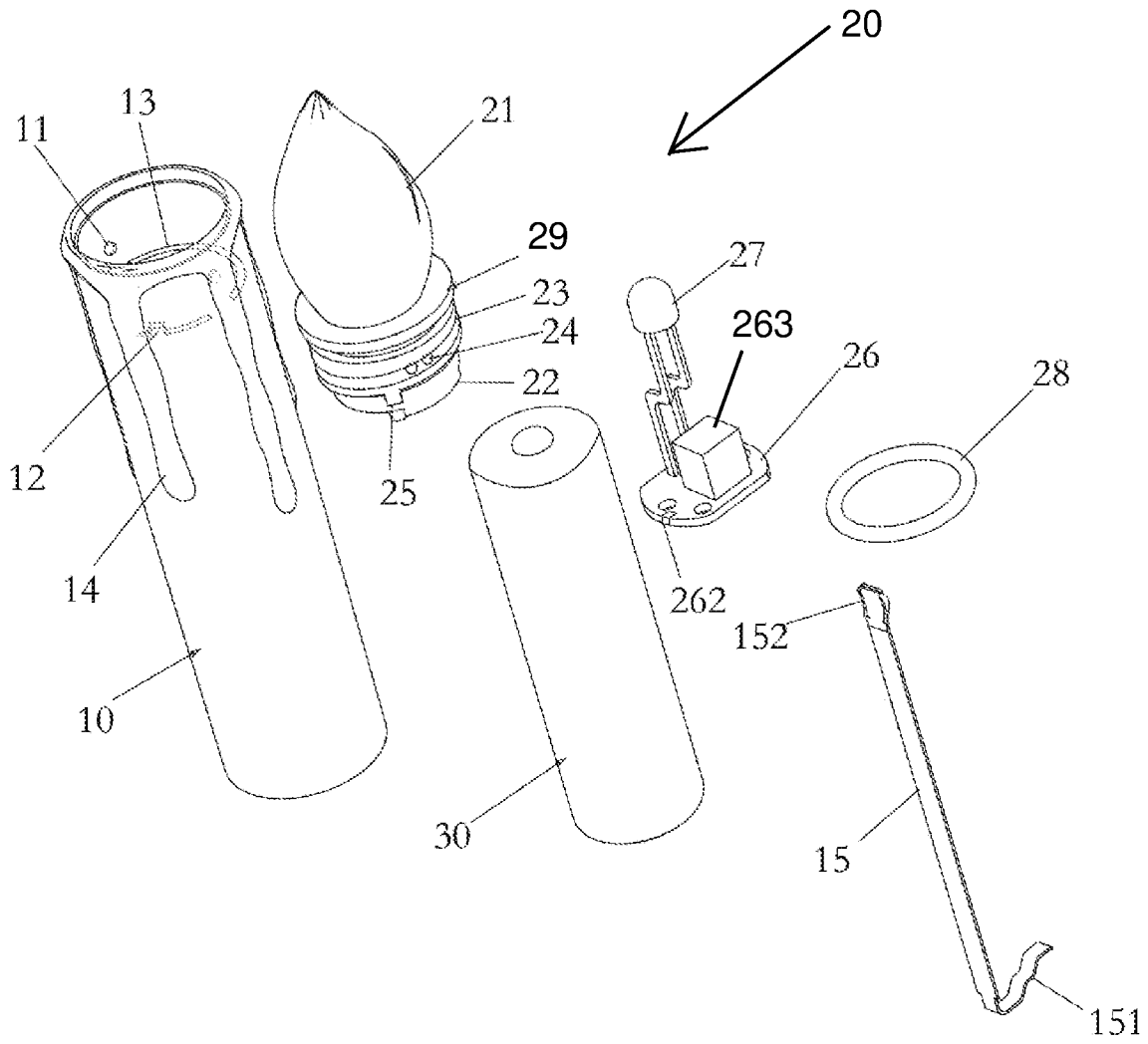
FIG. 1 is an exploded view of a lamp of the invention.

The invention will be described more fully herein after with reference to the accompanying figures, in which examples of the invention are shown. The invention may, however, be embodied in many alternate forms and should not be construed as limited to the examples set forth herein. Accordingly, while the invention is susceptible to various modifications and alternative forms, specific examples thereof are shown by way of examples in the drawings and will herein be described in detail.

Referring to FIGS. 1 to 4, a lamp of the invention is shaped as a candle and comprises a lamp body 10 and an illumination assembly 20 as discussed in detail below. The illumination assembly 20 comprises a lamp shade assembly 29 and a lamp board 26. The lamp shade assembly 29 includes a shade 21 and a seat 22 integrally formed with the shade 21. The seat 22 is threadedly secured to the lamp body 10. The lamp board 26 is secured to a lower end of the seat 22 and laterally extends out of the seat 22. The lamp board 26 serves as a bottom of the seat 22. The lamp board 26 includes two first electrodes 261 fastened on a bottom and a plurality of second electrodes 262 adjacent to the edge. The first electrodes 261 and the second electrodes 262 are electrically connected to a positive terminal and a negative terminal of a control circuit 263 of the lamp board 26 respectively. The first electrodes 261 and the second electrodes 262 are conductive contacts of the lamp board 26.

They are manufactured by means of lateral deposit technology and are more cost effective and durable in comparison with the conventional resilient piece based switch.

The control circuit is provided on a circuit of the lamp board 26 and includes a positive terminal of a battery on an underside of the lamp board 26 and a negative terminal of the battery on an edge of the lamp board 26. It is noted that for the LED lamp the solder surface is the front surface.

Figure 2:
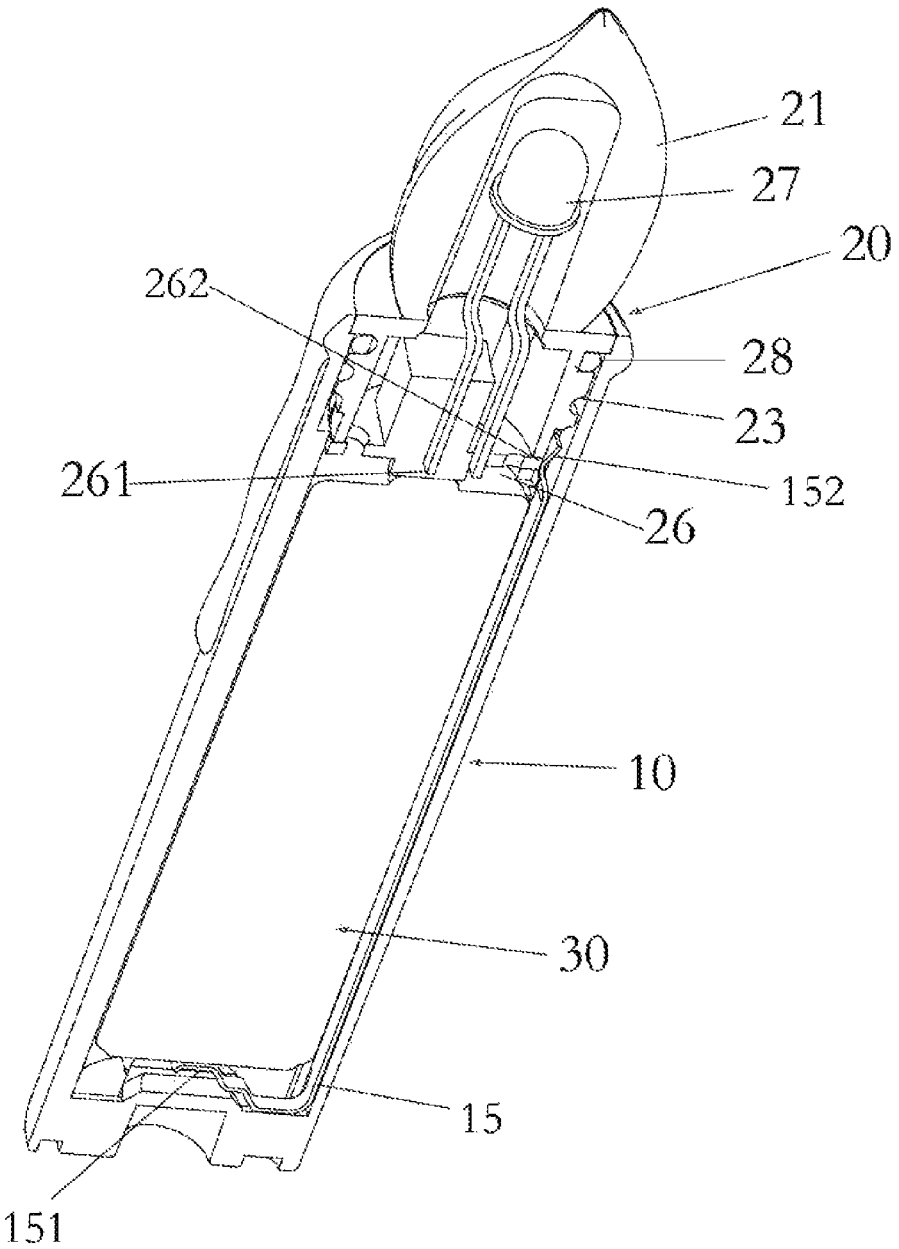
FIG. 2 is a fragmentary view of the assembled lamp.
Figure 3:
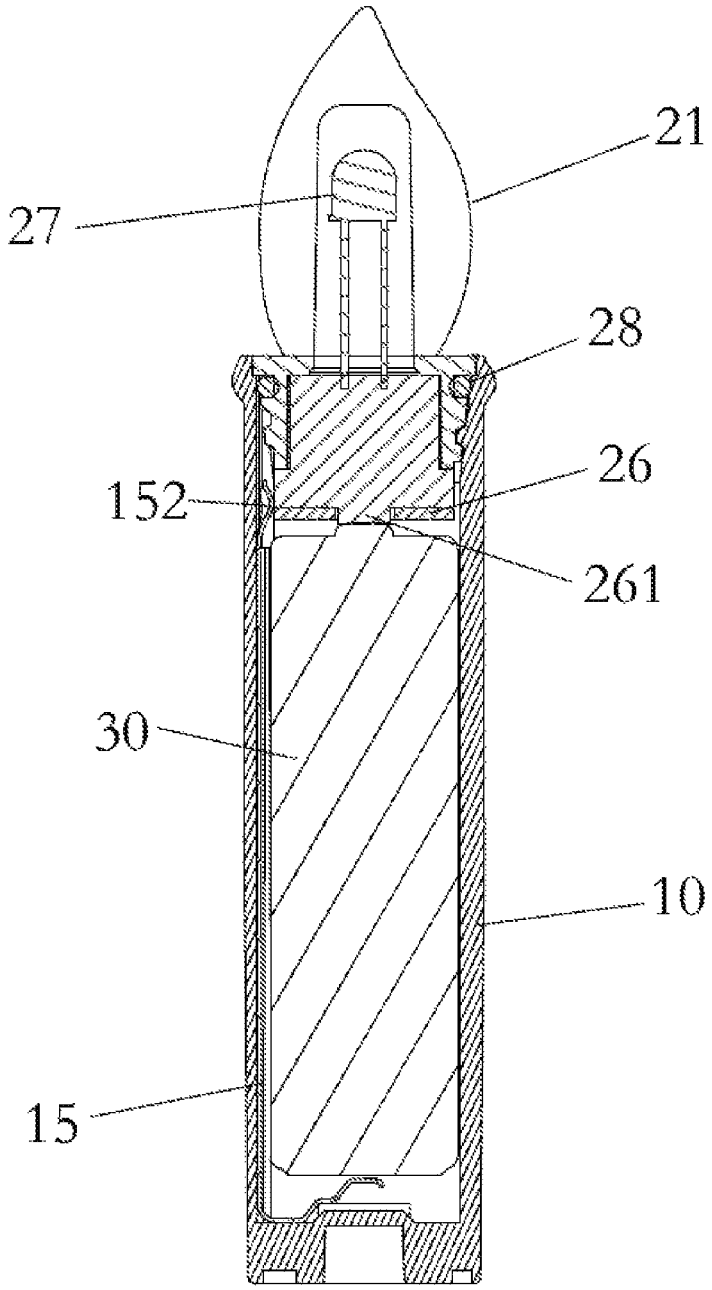
FIG. 3 is a longitudinal sectional view of the assembled lamp.
Figure 4:
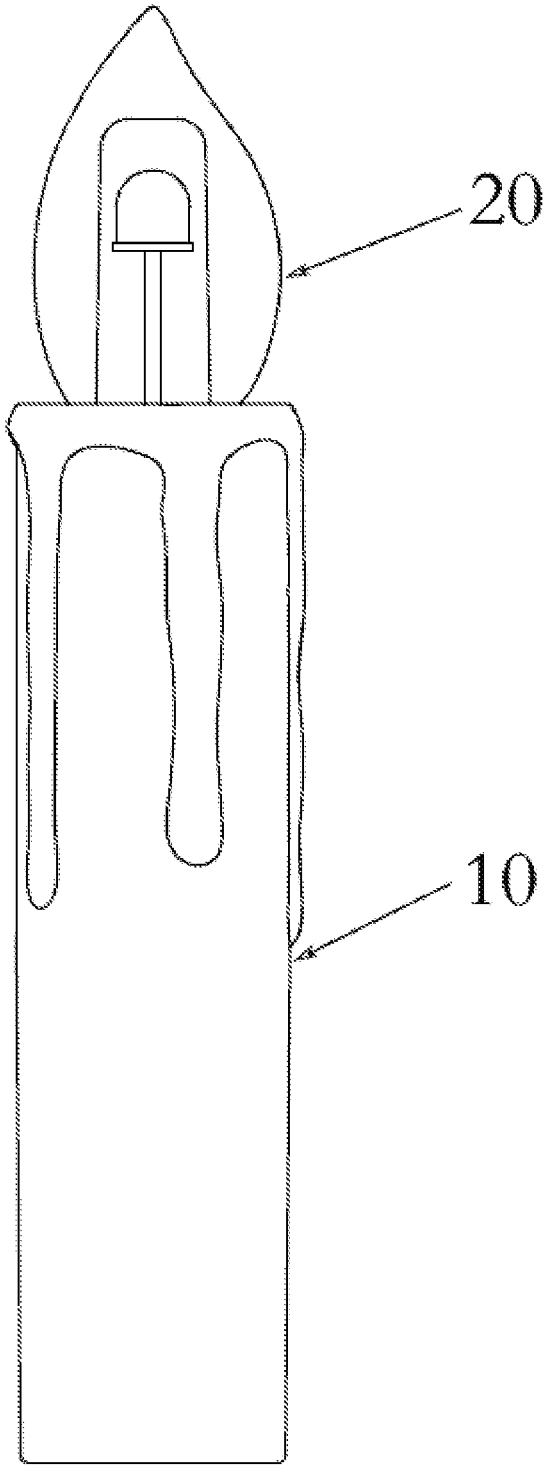
FIG. 4 is a side elevation of the assembled lamp.

As shown in FIGS. 1 to 3 specifically, the lamp body 10 is a hollow cylinder and has an opening on a top. A battery 30 is disposed in the lamp body 10. A resilient electrode 15 is provided in the lamp body 10 and includes a first end 151 on a bottom of the lamp body 10 and electrically connected to a negative terminal of the battery 30. The resilient electrode 15 is engaged with an inner surface of the lamp body 10. A second end 152 of the resilient electrode 15 is provided on an end of a shoulder of the battery 30 and in contact with the second electrode 262. The first electrodes 261 are electrically connected to the positive terminal of the battery 30. A circuit is formed when the second end 152 of the resilient electrode 15 contacts the second electrode 262 of the lamp board 26. The first electrodes 261 and the second electrodes 262 are positive and negative terminals of a light source 27 respectively. As a result, an LED 27 is lit.

The second electrodes 262 are manufactured by means of lateral deposit technology and have metal contact points or metal contact pieces at the edge of the lamp board 26. Further, the second electrodes 262 extend toward a circuit board of the lamp board 26 to electrically connect thereto. The second electrodes 262 and the first electrodes 261 form a circuit when the battery 30 is installed.

The second electrodes 262 include one or more contact points at the edge of the lamp board 26.

Screw threads 23 are above the seat 22 and threadedly secured to a threaded section 13 on the inner surface of the lamp body 10. A plurality of pairs of half-spherical second projections 24 are provided on the screw threads 23. A plurality of half-spherical first projections 11 are provided on the inner surface of the lamp body 10 above the threaded section 13. The first projection 11 is disposed between the second projections 24 of the same pair.

In an embodiment of the invention, the first projections 11 also serve as threads. The first projections 11 and the second projections 24 together form screw threads which meshes the screw threads 23 so that the illumination assembly 20 can be secured to the lamp body 10 by threadedly driving. In the step of threadedly driving, the first projections 11 and the second projections 24 cooperate to embody a manual movement of a switch and an electrode positioning.

While the first projections 11 and the second projections 24 are half-spherical, the first projections 11 and the second projections 24 can be any of other shapes in other embodiments of the invention.

A limit protuberance 25 is provided on the seat 22 and a cavity 12 is provided on the inner surface of the lamp body 10 for complementarily receiving the protuberance 25. The cavity 12 is adjacent to an end of the threaded section 13 so that the threads or the lamp body 10 may not be damaged when the illumination assembly 20 is threadedly secured to the lamp body 10.

There is an O-ring 28 provided in a groove above the screw threads 23 under the shade 21.

The LED 27 is capable of intermittently emitting color light so as to be more visually attractive. Alternatively, the LED 27 is capable of emitting light similar to candle light.

A pattern 14 is provided on an outer surface of the lamp body 10. As shown, the pattern 14 is shaped as traces of burned candle so that the lamp of the invention is more like a burning candle.

In the embodiment of the invention, a method of controlling on and off of the lamp comprises the steps of clockwise rotating the illumination assembly 20 to threadedly secure to the lamp body 10 so as to conduct positive and negative terminal of the LED 27 and turn on the LED 27; and counterclockwise rotating the illumination assembly 20 to threadedly unfasten the lamp body 10 so as to disconnect the positive terminal of the LED 27 from and the negative terminal thereof and turn off the LED 27.

The pairs of the second projections 24 are provided on the inner surface of the lamp body 10 above the threaded section 13. When the first projection 11 is disposed between the second projections 24 of the same pair by clockwise rotating, the positive and negative terminals of the LED 27 are conducted. To the contrary, when the first projection 11 is not disposed between the second projections 24 of the same pair by counterclockwise rotating, the positive and negative terminals of the LED 27 are not conducted. A click sound can be heard when the first projection 11 is disposed between the second projections 24 of the same pair, i.e., the LED 27 being lit.

The invention has the following advantages and benefits in comparison with the conventional art: a clockwise rotation turns on the lamp and a counterclockwise rotation turns off the lamp. It is simple and reliable and the hand feeling of the rotation is so right.

While the invention has been described in terms of preferred embodiments, those skilled in the art will recognize that the invention can be practiced with modifications within the spirit and scope of the appended claims.

What is claimed is:

1. A lamp comprising:

a lamp body being a hollow cylinder and having an opening on a top;

a battery disposed in the lamp body;

a resilient electrode disposed in the lamp body, the resilient electrode having a first end on a bottom of the lamp body and engaged with an inner surface of the lamp body, and a second end on an end of the battery, the second end being in contact with the second electrode;

an illumination assembly comprising a lamp shade assembly including a shade and a seat; and a lamp board;

a plurality of screw threads disposed above the seat;

a threaded section disposed on the inner surface of the lamp body, the threaded section being secured to the screw threads;

a limit protuberance disposed on the seat;

a cavity disposed on the inner surface of the lamp body for complementarily receiving the limit protuberance, wherein the cavity is adjacent to an end of the threaded section;

a plurality of first projections disposed on the inner surface of the lamp body above the threaded section, the first projections being configured as threads; and a plurality of pairs of second projections disposed on the screw threads;

wherein the seat is threadedly secured to the lamp body;

wherein the lamp board is secured to a lower end of the seat and laterally extends out of the seat;

wherein the lamp board is configured as a bottom of the seat;

wherein the lamp board includes two first electrodes fastened on a bottom and a plurality of second electrodes adjacent to an edge;

wherein the first electrodes and the second electrodes are electrically connected to a positive terminal and a negative terminal of a control circuit of the lamp board respectively;

wherein the first electrodes and the second electrodes are positive and negative terminals of a light source respectively;

wherein an electrical connection of the first electrodes and the second electrodes activates the control circuit of the lamp board and turns on the light source; and wherein an electrical disconnection of the first electrodes from the second electrodes deactivates the control circuit of the lamp board and turns off the light source.

* * * * *